US009761178B2

(12) United States Patent
Park et al.

(10) Patent No.: US 9,761,178 B2
(45) Date of Patent: Sep. 12, 2017

(54) GAMMA VOLTAGE GENERATOR AND DISPLAY DEVICE INCLUDING THE SAME

(71) Applicant: SAMSUNG DISPLAY CO., LTD., Yongin, Gyeonggi-Do (KR)

(72) Inventors: Dong-Wan Park, Gumi-si (KR); Sang-Hun Park, Cheonan-si (KR); Myoung-Seop Song, Asan-si (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 23 days.

(21) Appl. No.: 14/672,424

(22) Filed: Mar. 30, 2015

(65) Prior Publication Data

US 2016/0117992 A1 Apr. 28, 2016

(30) Foreign Application Priority Data

Oct. 28, 2014 (KR) ..... 10-2014-0147524

(51) Int. Cl.
*G09G 3/3275* (2016.01)

(52) U.S. Cl.
CPC ... *G09G 3/3275* (2013.01); *G09G 2310/0243* (2013.01); *G09G 2320/0673* (2013.01); *G09G 2330/021* (2013.01); *G09G 2330/028* (2013.01)

(58) Field of Classification Search
CPC ..... G09G 3/3275–3/3291; G09G 3/3685–3/3696; G09G 2310/0243; G09G 2310/027
See application file for complete search history.

(56) References Cited

U.S. PATENT DOCUMENTS 6,798,368 B2 * 9/2004 Jung ..... G09G 3/3688 341/118
8,144,044 B2 * 3/2012 Hirai ..... H03M 1/682 341/145
8,610,658 B2 * 12/2013 Haupt ..... G09G 3/3688 341/144
8,610,702 B2 * 12/2013 Kim ..... G09G 3/3696 345/212

(Continued)

FOREIGN PATENT DOCUMENTS

KR 10-2003-0081610 A 10/2003
KR 10-2007-0081806 A 8/2007

(Continued)

OTHER PUBLICATIONS

Extended European Search Report dated Jan. 7, 2016 in Corresponding European Patent Application No. 15168810.8.

*Primary Examiner* — Patrick F Marinelli
(74) *Attorney, Agent, or Firm* — Lee & Morse, P.C.

(57) ABSTRACT

A gamma voltage generator includes a resistor string, a gamma voltage provider, and a power supply string point. The resistor string provides a plurality of string voltages through a plurality of resistor string points. The resistor string is connected between a first gamma power supply voltage and a second gamma power supply voltage. The gamma voltage provider provides a plurality of gamma voltages based on the plurality of string voltages. A power supply string point to which the second gamma power supply voltage is applied is determined as the first gamma power supply voltage is changed. The power supply string point corresponds one of the resistor string points.

20 Claims, 11 Drawing Sheets

(56) References Cited

U.S. PATENT DOCUMENTS 8,681,031 B2 * 3/2014 Hirai ..... H03M 1/682 341/144
8,730,223 B2 * 5/2014 Kim ..... G09G 3/3648 345/204
8,730,227 B2 * 5/2014 Lee ..... G09G 3/3696 345/204
8,786,589 B2 * 7/2014 Park ..... G09G 3/3225 345/211
8,803,862 B2 * 8/2014 Lee ..... G09G 3/3655 338/295
8,836,733 B2 * 9/2014 Lee ..... G09G 5/10 345/690
9,182,805 B2 * 11/2015 Kim ..... G06F 1/3265
9,275,600 B2 * 3/2016 Zhu ..... G09G 3/3696
9,275,606 B2 * 3/2016 Lee ..... G09G 5/02
2003/0030631 A1 2/2003 Chen et al.
2003/0201955 A1 10/2003 Song et al.
2007/0002188 A1 * 1/2007 Kumagai ..... G09G 3/2011 348/751
2007/0188430 A1 8/2007 Moon
2008/0291190 A1 * 11/2008 Kim ..... G09G 3/3648 345/211
2009/0040244 A1 * 2/2009 Lee ..... G09G 3/3696 345/690
2009/0213042 A1 8/2009 Hagino et al.
2010/0001984 A1 * 1/2010 Kim ..... G09G 3/3696 345/212
2011/0006939 A1 * 1/2011 Hirai ..... H03M 1/682 341/145
2011/0227891 A1 * 9/2011 Lee ..... G09G 3/3655 345/211
2011/0298782 A1 * 12/2011 Park ..... G09G 3/3225 345/212
2012/0139769 A1 * 6/2012 Hirai ..... H03M 1/682 341/145
2012/0162272 A1 * 6/2012 Lee ..... G09G 5/10 345/690
2013/0002641 A1 * 1/2013 Kim ..... G09G 3/3685 345/212
2013/0083083 A1 4/2013 Woo et al.
2013/0249881 A1 * 9/2013 Chae ..... G09G 3/32 345/211
2013/0271507 A1 * 10/2013 Kim ..... G09G 3/3291 345/690
2014/0009512 A1 * 1/2014 Lee ..... G09G 5/02 345/690
2015/0228234 A1 * 8/2015 Lin ..... G09G 3/3614 345/212
2016/0117992 A1 * 4/2016 Park ..... G09G 3/3275 345/690

FOREIGN PATENT DOCUMENTS

KR 10-2009-0117209 A 11/2009
KR 10-2013-0035782 A 4/2013

* cited by examiner

FIG. 13

| VGS_RT[3:0] | UNIT-R | ΔV |
|---|---|---|
| 1H | 13 | 0.101 |
| 2H | 26 | 0.203 |
| 3H | 39 | 0.304 |
| 4H | 51 | 0.397 |
| 5H | 64 | 0.499 |
| 6H | 77 | 0.600 |
| 7H | 90 | 0.701 |
| 8H | 103 | 0.802 |
| 9H | 116 | 0.904 |
| AH | 128 | 0.998 |
| BH | 141 | 1.099 |
| CH | 154 | 1.201 |
| DH | 167 | 1.302 |
| EH | 180 | 1.404 |
| FH | 193 | 1.505 |

· R-STRING=860R
· 1UNIT-R=7.8mV

GAMMA VOLTAGE GENERATOR AND DISPLAY DEVICE INCLUDING THE SAME

CROSS REFERENCE TO RELATED APPLICATION

Korean Patent Application No. 10-2014-0147524, filed on Oct. 28, 2014, and entitled "Gamma Voltage Generator and Display Device Including the Same," is incorporated by reference herein in its entirety.

BACKGROUND

1. Field

One or more embodiments described herein relate to a gamma voltage generator and display device including a gamma voltage generator.

2. Description of the Related Art

The development of display devices with higher performance and speed continues to be a goal of system designers. One way of achieving higher performance and speed is to reduce power consumption of the display device.

SUMMARY

In accordance with one or more embodiments, a gamma voltage generator includes a resistor string to provide a plurality of string voltages through a plurality of resistor string points, the resistor string connected between a first gamma power supply voltage and a second gamma power supply voltage; and a gamma voltage provider to provide a plurality of gamma voltages based on the plurality of string voltages, wherein a power supply string point to which the second gamma power supply voltage is applied is determined as the first gamma power supply voltage is changed, the power supply string point corresponding one of the resistor string points.

The first gamma power supply voltage may be changed based on a delta voltage, and the delta voltage corresponds to a change of a reference voltage. When the reference voltage is decreased by the delta voltage, the first gamma power supply voltage may be decreased by the delta voltage.

The string voltages may be changed according to a delta voltage, and the delta voltage may correspond to a change of the first gamma power supply voltage. When the first gamma power supply voltage is decreased, the string voltages may be decreased.

As each of the string points approaches the first gamma power supply voltage, a resistor string point number corresponding to the resistor string points may be decreased, and a power supply string point number may be changed according to a delta voltage, the delta voltage corresponding to a change of the first gamma power supply voltage, the power supply string point number may correspond to the power supply string point. When the first gamma power supply voltage is decreased by the delta voltage, the power supply string point number may be decreased. When the first gamma power supply voltage is increased by the delta voltage, the power supply string point number may be increased.

The power supply string point may be connected to one end of the string resistor, that is connected to the second gamma power supply voltage. The second gamma power supply voltage may be a ground voltage. A second resistor string point among the plurality of resistor string points may be adjacent to a first resistor string point and a third resistor string point, and a difference between a first string voltage provided through the first resistor string point and a second string voltage provided through the second resistor string point may be substantially equal to a difference between the second string voltage provided through the second resistor string point and a third string voltage provided through the third resistor string point.

The gamma voltage generator may include a controller to control the first gamma power supply voltage and the power supply string point. The controller may include a register to store a register value, the register value to control the first gamma power supply voltage and the power supply string point. The controller may provide the first gamma power supply voltage and the power supply string point corresponding to the register value based on a control signal. When the gamma voltage generator operates in a power save mode, the first gamma power supply voltage may be decreased.

In accordance with one or more embodiments, a display device includes a data voltage generator to provide a data voltage based on display data; and a pixel array to display an image based on the data voltage, the data voltage generator including: a resistor string to provide a plurality of string voltages through a plurality of resistor string points, the resistor string connected between a first gamma power supply voltage and a second gamma power supply voltage; a gamma voltage provider to provide a plurality of gamma voltages based on the plurality of string voltages; and a data voltage to provide the data voltage corresponding to the display data based on the plurality of gamma voltages, wherein, a power supply string point to which the second gamma power supply voltage is applied is determined as the first gamma power supply voltage is changed, the power supply string point corresponding one of the resistor string points.

The first gamma power supply voltage, a reference voltage, and the plurality of string voltages may be changed according to a delta voltage, and the delta voltage may correspond to a change of a pixel power supply voltage that is provided to the pixel array. The first gamma power supply voltage and the reference voltage may be decreased by the delta voltage when the pixel power supply voltage is decreased by the delta voltage.

The display device may include a controller to control the pixel power supply voltage, the first gamma power supply voltage, and the power supply string point. The controller may include a register to store a register value, the register value to control the pixel power supply voltage, the first gamma power supply voltage, and the power supply string point, and the controller may provide the pixel power supply voltage, the first gamma power supply voltage, and the power supply string point corresponding to the register value based on a control signal.

BRIEF DESCRIPTION OF THE DRAWINGS

Features will become apparent to those of skill in the art by describing in detail exemplary embodiments with reference to the attached drawings in which:

FIGS. 12 and 13 illustrate embodiments for setting of a register in a controller.

DETAILED DESCRIPTION

Figure 1:
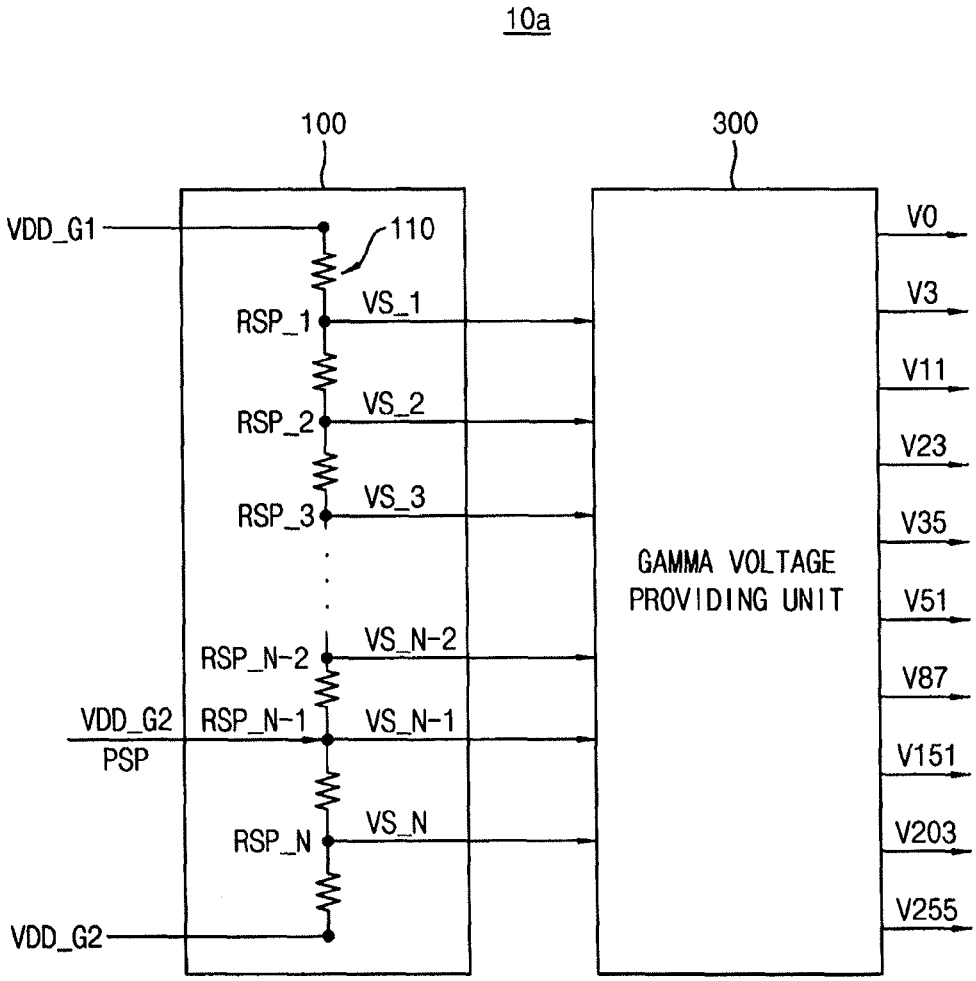
FIG. 1 illustrates an embodiment of a gamma voltage generator.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. In the drawings, the dimensions of layers and regions may be exaggerated for clarity of illustration. Like reference numerals refer to like elements throughout.

FIG. 1 illustrates an embodiment of a gamma voltage generator 10*a* which includes a string resistor unit 100 and a gamma voltage providing unit 300.

The string resistor unit 100 provides a plurality of string voltages VS_1 to VS_N through a plurality of resistor string points RSP_1 to RSP_N in a string resistor 110. The string resistor 110 is in the string resistor unit 100. The string resistor 110 is connected between a first gamma power supply voltage VDD_G1 and a second gamma power supply voltage VDD_G2. The string voltages VS_1 to VS_N may be between the first gamma power supply voltage VDD_G1 and the second gamma power supply voltage VDD_G2. For example, a first string voltage VS_1 may be provided from a first resistor string point RSP_1. A second string voltage VS_2 may be provided from a second resistor string point RSP_2. In the same manner, an N-th string voltage VS_N may be provided from an N-th resistor string point RSP_N.

The gamma voltage providing unit 300 provides a plurality of gamma voltages V0 to V255 based on the string voltages VS_1 to VS_N. For example, the gamma voltage providing unit 300 may include one or more multiplexers and resistors. The gamma voltage providing unit 300 may provide 1st to 256th gamma voltages V0 to V255 using a first to N-th string voltages VS_1 to VS_N, multiplexers, and resistors.

As the first gamma power supply voltage VDD_G1 is changed, a power supply string point PSP that the second gamma power supply voltage VDD_G2 is applied to is determined. The power supply string point PSP is one of resistor string points RSP_1 to RSP_N. For example, when the display device including the gamma voltage generator 10*a* operates in a power save mode PSM, the power supply voltage ELVDD may be decreased. When the power supply voltage ELVDD is decreased, the reference voltage VREF that is changed according to the power supply voltage ELVDD may be decreased.

For the same display data DD, a difference between the reference voltage VREF and the data voltage VD may be constant. When the display device including the gamma voltage generator 10*a* operates in a power save mode PSM, if the reference voltage VREF is decreased, the data voltage VD may also be decreased. For example, when the reference voltage VREF is decreased by the delta voltage DV, if the data voltage VD is decreased by the delta voltage DV, the difference between the reference voltage VREF and the data voltage VD may be constant.

To decrease the data voltage VD, the first gamma power supply voltage VDD_G1 that is provided to the string resistor unit 100 may be decreased. When the first gamma power supply voltage VDD_G1 that is provided to the string resistor unit 100 is decreased, the string voltages VS_1 to VS_N that are provided from the resistor string points RSP_1 to RSP_N may be decreased. When the string voltages VS_1 to VS_N are decreased, the data voltage VD corresponding to the display data DD may be decreased. Therefore, when the reference voltage VREF is decreased, the first gamma power supply voltage VDD_G1 may be decreased to decrease the data voltage VD.

However, when the first gamma power supply voltage VDD_G1 that is provided to the string resistor unit 100 is decreased, a voltage difference among the string voltages VS_1 to VS_N may be changed. For example, as will be described referring to FIG. 4, when the first gamma power supply voltage VDD_G1 is 1V, the first string voltage VS_1 provided from the first resistor string point RSP_1 may be 0.9V. The second string voltage VS_2 provided from the second resistor string point RSP_2 may be 0.8V. In the same manner, the ninth string voltage provided from the ninth resistor string point may be 0.1V. In this case, the voltage difference among the string voltages VS_1 to VS_N may be 0.1V.

For example, in case the first gamma power supply voltage VDD_G1 is 0.9V, the first string voltage VS_1 provided from the first resistor string point RSP_1 may be 0.81V. The second string voltage VS_2 provided from the second resistor string point RSP_2 may be 0.72V. In the same manner, the ninth string voltage provided from the ninth resistor string point may be 0.09V. In this case, the voltage difference among the string voltages VS_1 to VS_N may be 0.09V. The voltage difference among the string voltages VS_1 to VS_N is 0.1V, even though the first gamma power supply voltage VDD_G1 is changed.

Therefore, as the first gamma power supply voltage VDD_G1 is changed, the power supply string point PSP to which the second gamma power supply voltage VDD_G2 is applied may be changed. For example, as will be described referring to FIG. 5, when the first gamma power supply voltage VDD_G1 is 0.9V, the power supply string point PSP to which the second gamma power supply voltage VDD_G2 is applied may be a ninth resistor string point. In this case, the first string voltage VS_1 provided from the first resistor string point RSP_1 may be 0.8V. The second string voltage VS_2 provided from the second resistor string point RSP_2 may be 0.7V. In the same manner, the eighth string voltage provided from the eighth resistor string point may be 0.1V. In this case, the voltage difference among the string voltages VS_1 to VS_N may be 0.1V.

Therefore, when the power supply string point PSP to which the second gamma power supply voltage VDD_G2 is applied is changed as the first gamma power supply voltage VDD_G1 is changed, the voltage difference among the string voltages VS_1 to VS_N may be constant, even though the first gamma power supply voltage VDD_G1 is changed.

When the display device including the gamma voltage generator 10*a* operates in a power save mode PSM, the power supply voltage ELVDD may be decreased. When the power supply voltage ELVDD is decreased, the reference voltage VREF that is changed according to the power supply voltage ELVDD may be decreased. The data voltage VD may be decreased, so that the difference between the reference voltage VREF and the data voltage VD is constant for the same display data DD. To decrease the data voltage VD, string voltages VS_1 to VS_N provided from the string resistor unit 100 may be decreased. To decrease the string voltages VS_1 to VS_N, the first gamma power supply voltage VDD_G1 may be decreased. As the first gamma power supply voltage VDD_G1 is changed, the power supply string point PSP to which the second gamma power supply voltage VDD_G2 is applied may be changed.

In this embodiment, the gamma voltage generator 10*a* may decrease the power consumption by applying the second gamma power supply voltage VDD_G2 to the power string point selected among the resistor string points RSP_1 to RSP_N, as the first gamma power supply voltage VDD_G1 is changed.

Figure 2:
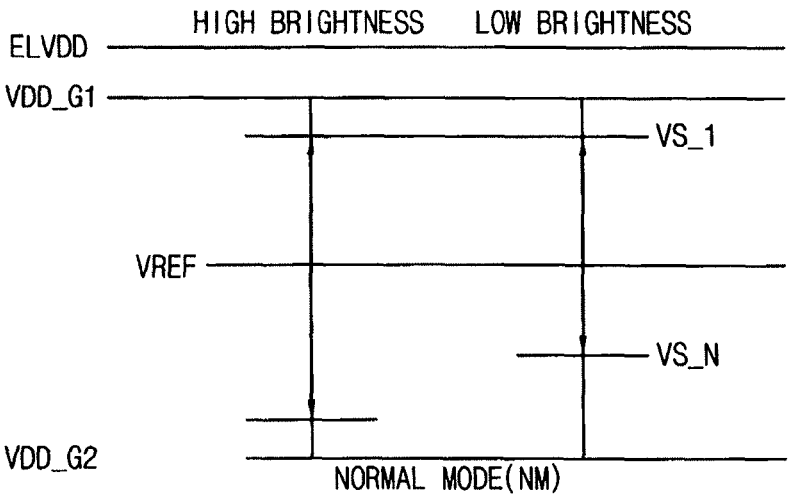
FIG. 2 illustrates an example of normal mode of a display device.
Figure 3:
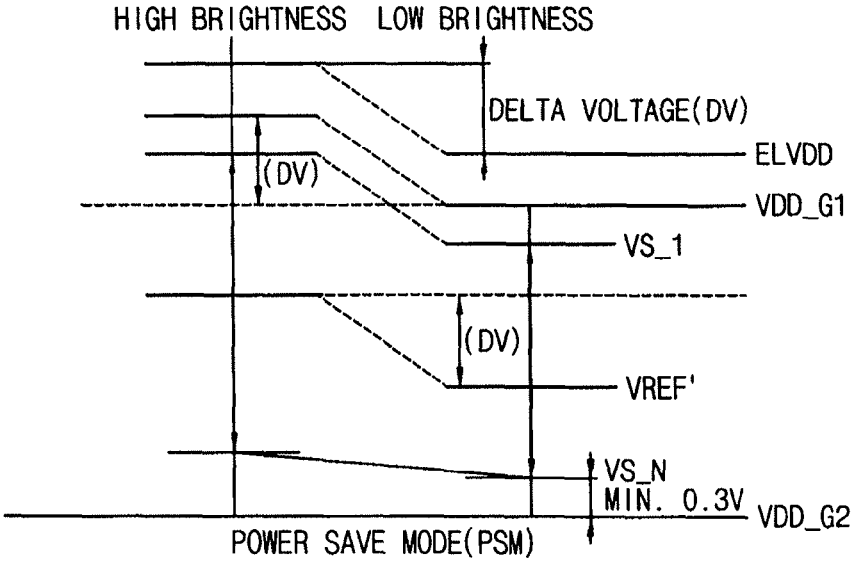
FIG. 3 illustrates an example of a power save mode of a display device.

FIG. 2 illustrates an example of a normal mode NM of operation of a display device, which, for example, includes the gamma voltage generator of FIG. 1. FIG. 3 illustrates an example of a power save mode PSM of operation of the display device.

Referring to FIGS. 2 and 3, when the display device including the gamma voltage generator 10*a* operates in the normal mode NM, the power supply voltage ELVDD used for high brightness may be equal to the power supply voltage ELVDD used for low brightness. The reference voltage VREF may be changed according to the power supply voltage ELVDD. When the display device operates in the normal mode NM, the reference voltage VREF used for high brightness may be equal to the reference voltage VREF used for low brightness. In this case, the first string voltage VS_1 for high brightness may be equal to the first string voltage VS_1 for low brightness. In addition, the N-th string voltage VS_N for high brightness may be equal to the N-th string voltage VS_N for low brightness.

When the display device operates in the power save mode PSM, the power supply voltage ELVDD used for low brightness may be less than the power supply voltage ELVDD used for high brightness. For example, a voltage difference between the power supply voltage ELVDD used for low brightness and the power supply voltage ELVDD used for high brightness may be a delta voltage DV.

When the display device operates in the power save mode PSM, the reference voltage VREF used for low brightness may be less than the reference voltage VREF used for high brightness. For example, a voltage difference between the reference voltage VREF used for low brightness and the reference voltage VREF used for high brightness may be the delta voltage DV. The string voltages VS_1 to VS_N may be decreased, so that the difference between the reference voltage VREF and the data voltage VD is constant for the same display data DD.

To decrease the string voltages, the first gamma power supply voltage VDD_G1 may be decreased. As the first gamma power supply voltage VDD_G1 is changed, the power supply string point PSP to which the second gamma power supply voltage VDD_G2 is applied may be changed, so that the voltage difference among the string voltages VS_1 to VS_N is constant. In this case, the first string voltage VS_1 for low brightness may be less than the first string voltage VS_1 for high brightness. In addition, the N-th string voltage VS_N for low brightness may be less than the N-th string voltage VS_N for high brightness.

In an example embodiment, the first gamma power supply voltage VDD_G1 may be changed according to a delta voltage DV. The delta voltage DV may correspond to a change of a reference voltage VREF. For example, when the reference voltage VREF is decreased by the delta voltage DV, the first gamma power supply voltage may be decreased by the delta voltage DV.

In this embodiment, the gamma voltage generator 10*a* may decrease power consumption by applying the second gamma power supply voltage VDD_G2 to the power string point that is selected among the resistor string points RSP_1 to RSP_N, as the first gamma power supply voltage VDD_G1 is changed.

Figure 4:
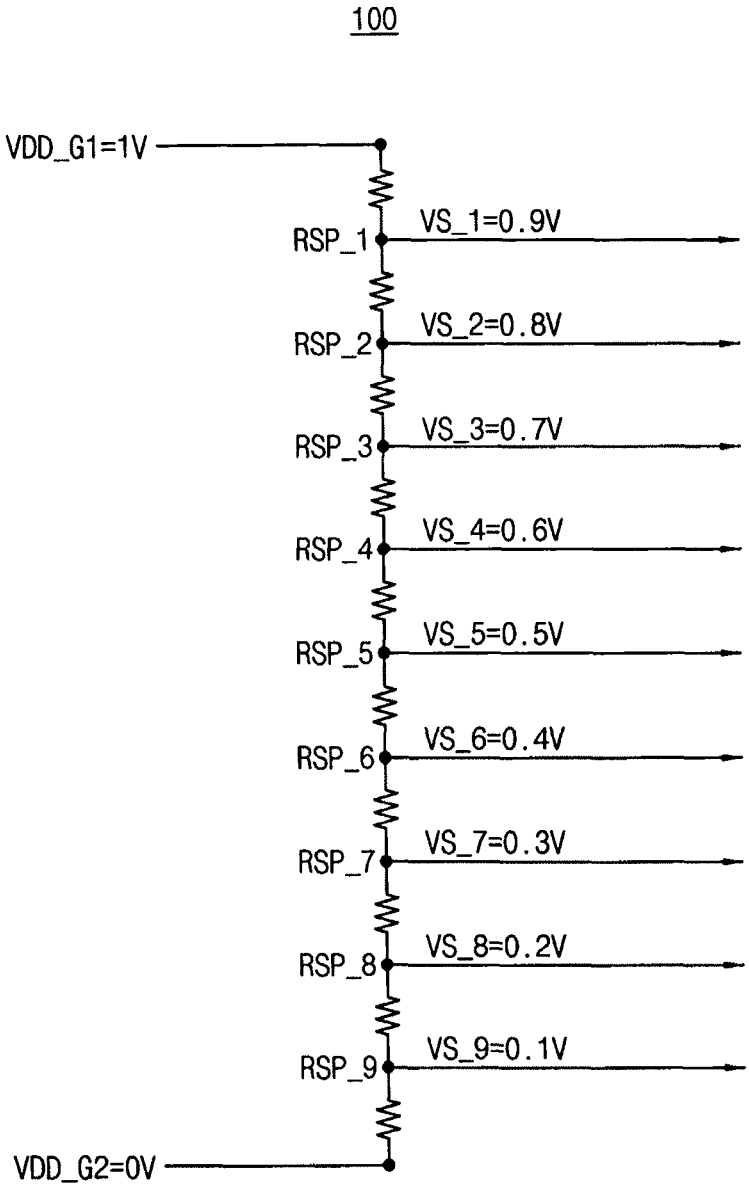
FIG. 4 illustrates an example of a string resistor unit.
Figure 5:
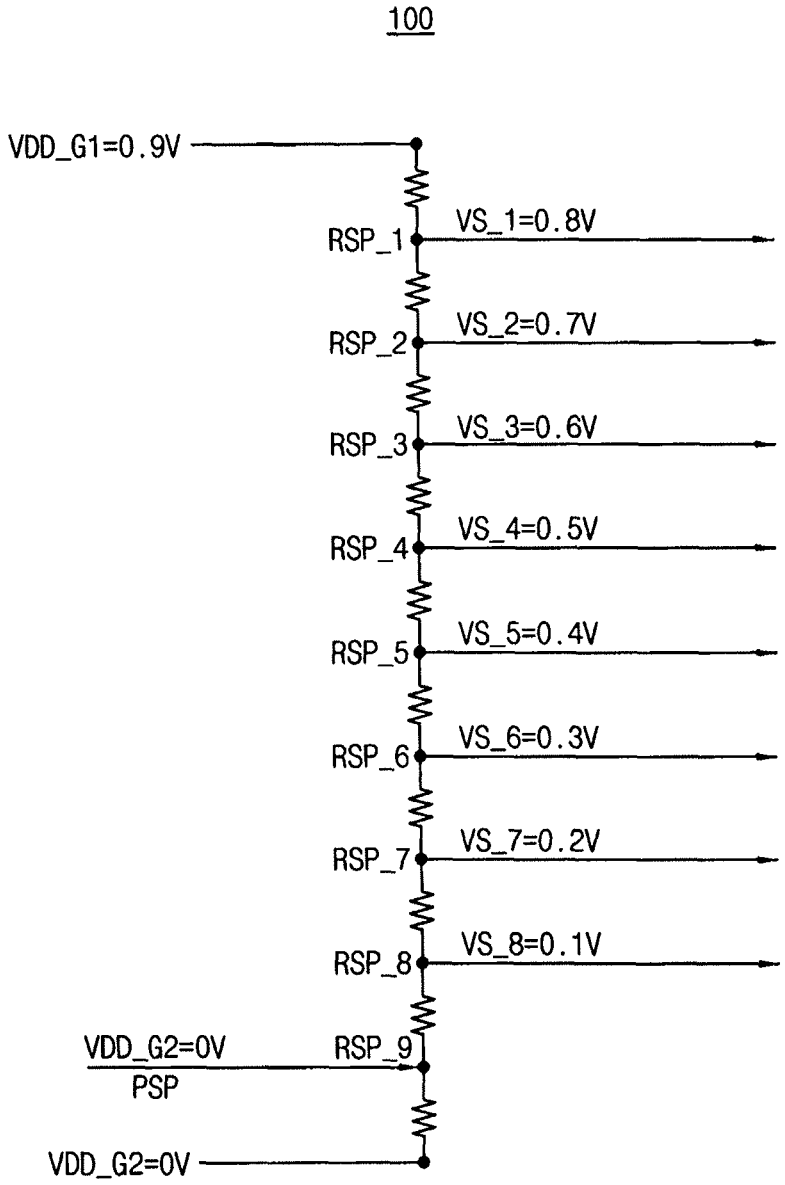
FIG. 5 illustrates an example of a power supply string point.

FIG. 4 illustrates an example of a string resistor unit in the gamma voltage generator of FIG. 1, and FIG. 5 illustrates an example of a power supply string point PSP that is changed as a first gamma power supply voltage is changed.

Referring to FIGS. 4 and 5, when the first gamma power supply voltage VDD_G1 is 1V, the first string voltage VS_1 provided from the first resistor string point RSP_1 may be 0.9V. The second string voltage VS_2 provided from the second resistor string point RSP_2 may be 0.8V. In the same manner, the ninth string voltage provided from the ninth resistor string point may be 0.1V. In this case, the voltage difference among the string voltages VS_1 to VS_N may be 0.1V.

The power supply voltage ELVDD of the display device may be changed. When the power supply voltage ELVDD of the display device is changed, the reference voltage VREF may be changed. The data voltage VD may be decreased so that the difference between the reference voltage VREF and the data voltage VD is constant for the same display data DD. To decrease the data voltage VD, string voltages VS_1 to VS_N provided from the string resistor unit 100 may be decreased. To decrease the string voltages VS_1 to VS_N, the first gamma power supply voltage VDD_G1 may be decreased. As the first gamma power supply voltage VDD_G1 is changed, the power supply string point PSP to which the second gamma power supply voltage VDD_G2 is applied may be selected.

For example, when the mode of the display device is changed from the normal mode NM to the power save mode PSM, the power supply voltage ELVDD of the display device may be decreased by the delta voltage DV. When the power supply voltage ELVDD of the display device is decreased by the delta voltage DV, the reference voltage VREF may be decreased by the delta voltage DV. When the reference voltage VREF is decreased by the delta voltage DV, the first gamma power supply voltage VDD_G1 may be decreased by the delta voltage DV, to decrease the data voltage VD. The power supply string point PSP to which the second gamma power supply voltage VDD_G2 is applied may be selected.

For example, referring to FIGS. 4 and 5, the delta voltage DV may be 0.1V. The power supply voltage ELVDD of the display device may be decreased by 0.1V. When the power supply voltage ELVDD of the display device is decreased by 0.1V, the reference voltage VREF may be decreased by 0.1V. When the reference voltage VREF is decreased by 0.1V, the first gamma power supply voltage VDD_G1 may be decreased by 0.1V, to decrease the data voltage VD. In this case, the power supply string point PSP may be the ninth resistor string point. The second gamma power supply voltage VDD_G2 may be applied to the ninth resistor string point. The second gamma power supply voltage VDD_G2 may be a ground voltage.

For example, when the first gamma power supply voltage VDD_G1 is changed from 1V to 0.9V, the first string voltage VS_1 provided from the first resistor string point RSP_1 may be 0.8V. The second string voltage VS_2 provided from the second resistor string point RSP_2 may be 0.7V. In the same manner, the eighth string voltage provided from the eighth resistor string point may be 0.1V. In this case, the voltage difference among the string voltages VS_1 to VS_N may be 0.1V.

Therefore, when the power supply string point PSP is changed as the first gamma power supply voltage VDD_G1 is changed, the voltage difference among the string voltages VS_1 to VS_N may be constant even though the first gamma power supply voltage VDD_G1 is changed.

In this embodiment, the gamma voltage generator 10*a* may decrease power consumption by applying the second gamma power supply voltage VDD_G2 to the power string point that is selected among the resistor string points RSP_1 to RSP_N, as the first gamma power supply voltage VDD_G1 is changed.

Figure 6:
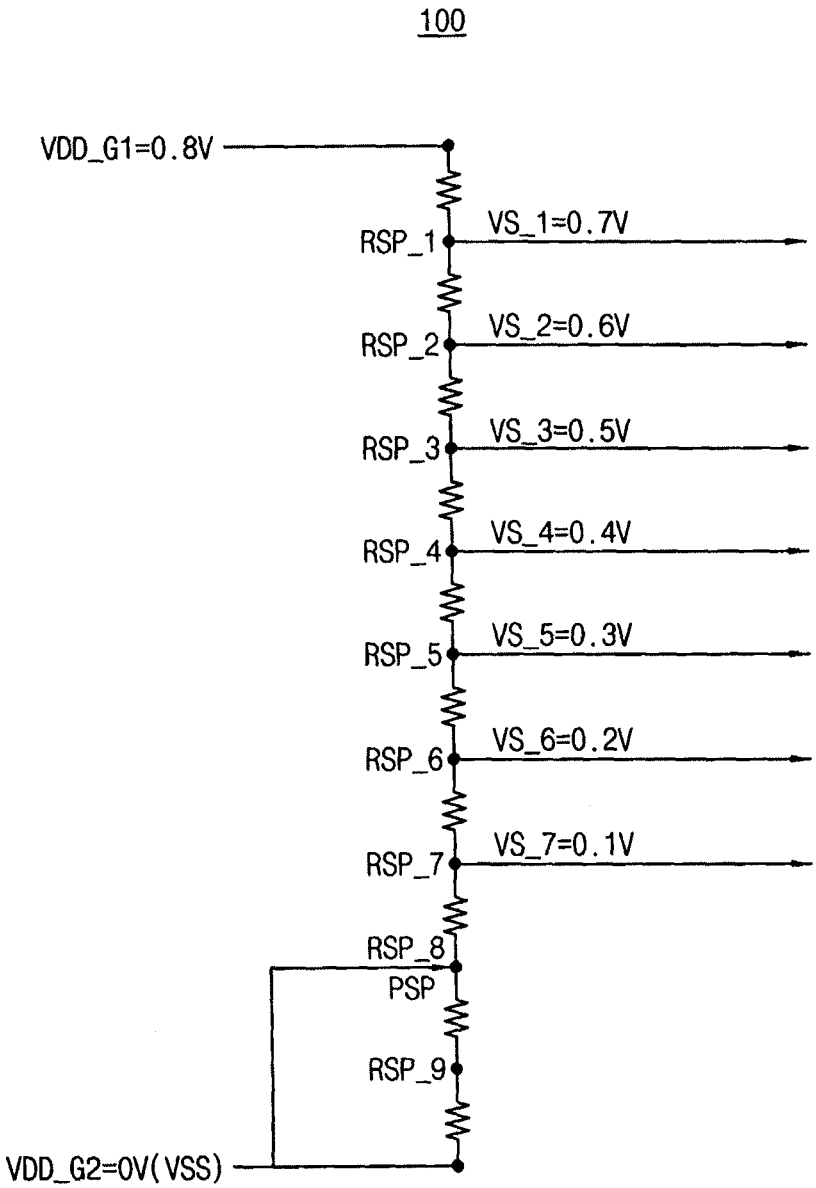
FIG. 6 illustrates another example of a power supply string point.

FIG. 6 illustrates another example of a power supply string point that is changed as a first gamma power supply voltage is changed. Referring to FIG. 6, the power supply voltage ELVDD of the display device may be further decreased by 0.1V. When the power supply voltage ELVDD of the display device is further decreased by 0.1V, the reference voltage VREF may be further decreased by 0.1V. When the reference voltage VREF is further decreased by 0.1V, the first gamma power supply voltage VDD_G1 may be further decreased by 0.1V to decrease the data voltage VD.

In this case, the power supply string point PSP may be the eighth resistor string point. The second gamma power supply voltage VDD_G2 may be applied to the eighth resistor string point. The second gamma power supply voltage VDD_G2 may be a ground voltage. In this case, the voltage that is provided from the ninth resistor string point may not be used.

For example, in case the first gamma power supply voltage VDD_G1 is changed from 0.9V to 0.8V, the first string voltage VS_1 provided from the first resistor string point RSP_1 may be 0.7V. The second string voltage VS_2 provided from the second resistor string point RSP_2 may be 0.6V. In the same manner, the seventh string voltage provided from the seventh resistor string point may be 0.1V. In this case, the voltage difference among the string voltages VS_1 to VS_N may be 0.1V.

Therefore, when the power supply string point PSP is changed as the first gamma power supply voltage VDD_G1 is changed, the voltage difference among the string voltages VS_1 to VS_N may be constant even though the first gamma power supply voltage VDD_G1 is changed.

In this embodiment, the plurality of string voltages VS_1 to VS_N may be changed according to a delta voltage DV. The delta voltage DV may correspond to a change of the first gamma power supply voltage VDD_G1. For example, when the first gamma power supply voltage VDD_G1 is decreased, the plurality of string voltages VS_1 to VS_N may be decreased.

Also, in this embodiment, as each of the plurality of string points is close to the first gamma power supply voltage VDD_G1, a resistor string point number corresponding to each of the plurality of resistor string points RSP_1 to RSP_N may be decreased. For example, the resistor string point closest to the first gamma power supply voltage VDD_G1 may be the first resistor string point RSP_1. The resistor string point number corresponding to the first resistor string point RSP_1 may be 1. The resistor string point farthest from the first gamma power supply voltage VDD_G1 may be the nine resistor string point. The resistor string point number corresponding to the nine resistor string point may be 9.

A power supply string point number PSPN may be changed according to a delta voltage DV. The delta voltage DV may correspond to a change of the first gamma power supply voltage VDD_G1. The power supply string point number PSPN may correspond to the power supply string point PSP. In an example embodiment, when the first gamma power supply voltage VDD_G1 is decreased by the delta voltage DV, the power supply string point number PSPN may be decreased. For example, when the first gamma power supply voltage VDD_G1 is 0.9V, the resistor string point number corresponding to the power supply string point PSP may be 9. In this case, the power supply string point number PSPN may be 9. When the first gamma power supply voltage VDD_G1 is 0.8V, the resistor string point number corresponding to the power supply string point PSP may be 8. In this case, the power supply string point number PSPN may be 8. Therefore, the power supply string point number PSPN may be changed according to a delta voltage DV.

In an example embodiment, when the first gamma power supply voltage VDD_G1 is increased by the delta voltage DV, the power supply string point number PSPN may be increased. For example, when the first gamma power supply voltage VDD_G1 is increased from 0.8V to 0.9V, the power supply string point PSP may be increased from the eighth resistor string point to the ninth resistor string point. The power supply string point number PSPN may be changed from 8 to 9.

In an example embodiment, the power supply string point PSP may be connected to one end of the string resistor 110 that is connected to the second gamma power supply voltage VDD_G2. For example, the resistor string point corresponding to the power supply string point PSP may be connected to one end of the string resistor 110, that is connected to the second gamma power supply voltage VDD_G2.

In an example embodiment, the second gamma power supply voltage VDD_G2 may be a ground voltage. For example, in case the second gamma power supply voltage VDD_G2 is the ground voltage, the ground voltage may be applied to the resistor string point corresponding to the power supply string point PSP.

In an example, embodiment, a second resistor string point RSP2 among the plurality of resistor string points RSP_1 to RSP_N may be adjacent to a first resistor string point RSP_1 and a third resistor string point RSP_3. The difference between a first string voltage VS_1 provided through the first resistor string point RSP_1 and a second string voltage VS_2 provided through the second resistor string point RSP_2 may be equal to a difference between the second string voltage VS_2 provided through the second resistor string point RSP_2 and a third string voltage VS_3 provided through the third resistor string point RSP_3.

For example, in FIG. 6, the first string voltage VS_1 that is provided from the first resistor string point RSP_1 may be 0.7V. The second string voltage VS_2 provided from the second resistor string point RSP_2 may be 0.6V. The third string voltage VS_3 provided from the third resistor string point RSP_3 may be 0.5V. The difference between the first string voltage VS_1 and the second string voltage VS_2 may be 0.1V. The difference between the second string voltage VS_2 and the third string voltage VS_3 may be 0.1V.

Therefore, the difference between the first string voltage VS_1 and the second string voltage VS_2 may be equal to the difference between the second string voltage VS_2 and the third string voltage VS_3.

Figure 7:
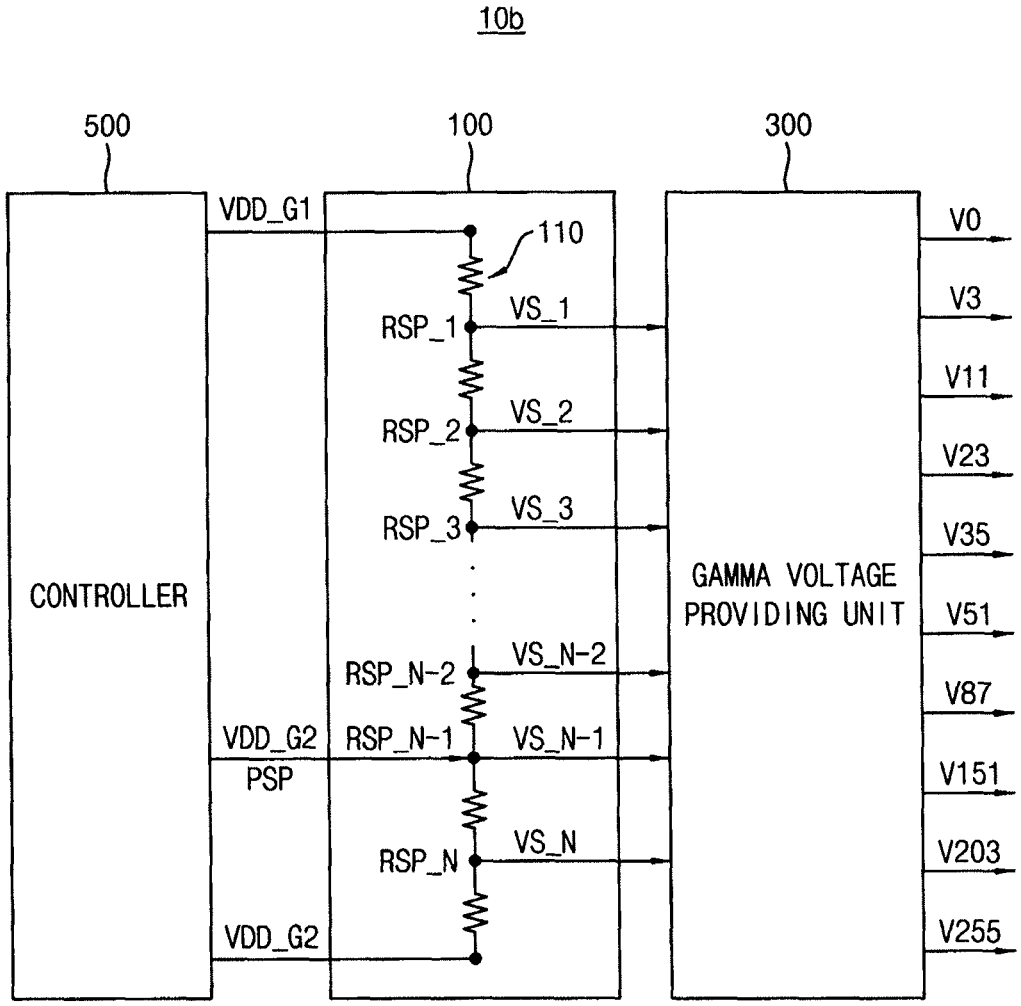
FIG. 7 illustrates another embodiment of a gamma voltage generator.
Figure 8:
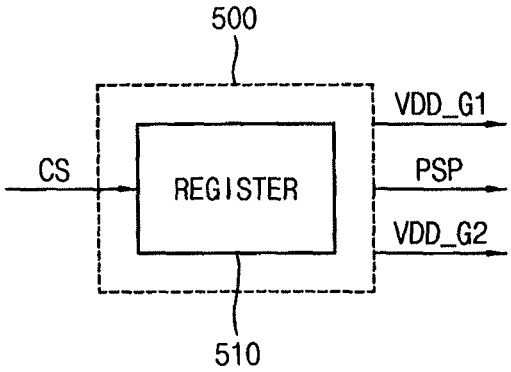
FIG. 8 illustrates an example of a controller in a gamma voltage generator.

FIG. 7 illustrates another embodiment of a gamma voltage generator 10*b*, and FIG. 8 illustrates an example of a controller in the gamma voltage generator of FIG. 7.

Referring to FIGS. 7 and 8, the gamma voltage generator 10*b* includes a string resistor unit 100 and a gamma voltage providing unit 300. The string resistor unit 100 provides a plurality of string voltages VS_1 to VS_N through a plurality of resistor string points RSP_1 to RSP_N in a string resistor 110.

The string resistor 110 is in the string resistor unit 100. The string resistor 110 is connected between a first gamma power supply voltage VDD_G1 and a second gamma power supply voltage VDD_G2. The plurality of string voltages VS_1 to VS_N may be voltages between the first gamma power supply voltage VDD_G1 and the second gamma power supply voltage VDD_G2.

The gamma voltage providing unit 300 provides a plurality of gamma voltages V0 to V255 based on the plurality of string voltages VS_1 to VS_N. As the first gamma power supply voltage VDD_G1 is changed, a power supply string point PSP to which the second gamma power supply voltage VDD_G2 is applied is determined. The power supply string point PSP is one of the plurality of resistor string points RSP_1 to RSP_N.

In an example embodiment, the gamma voltage generator 10*b* may further include a controller 500 that controls the first gamma power supply voltage VDD_G1 and the power supply string point PSP. For example, the controller 500 may control the first gamma power supply voltage VDD_G1 that is provided to the string resistor unit 100. As the first gamma power supply voltage VDD_G1 is changed, the power supply string point PSP to which the second gamma power supply voltage VDD_G2 is applied may be changed. The controller 500 may provide the power supply string point PSP to the string resistor unit 100. In this case, the string resistor unit 100 may determine the resistor string point that the second gamma power supply voltage VDD_G2 is applied to based on the power supply string point PSP.

In an example embodiment, the controller 500 may include a register 510 storing a register value. The register value may control the first gamma power supply voltage VDD_G1 and the power supply string point PSP. For example, the controller 500 may provide the first gamma power supply voltage and the power supply string point PSP corresponding to the register value based on the control signal. In the gamma voltage generator 10*a* operates in the power save mode PSM, the first gamma power supply voltage VDD_G1 may be decreased.

Figure 9:
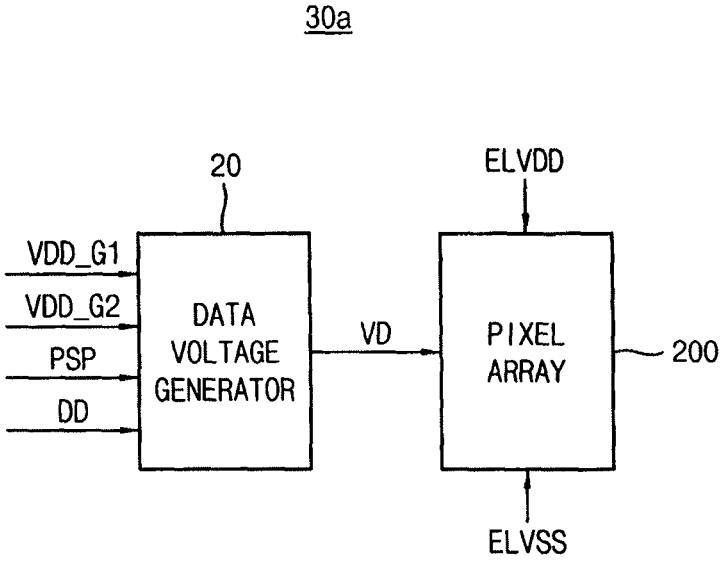
FIG. 9 illustrates an embodiment of a display device.
Figure 10:
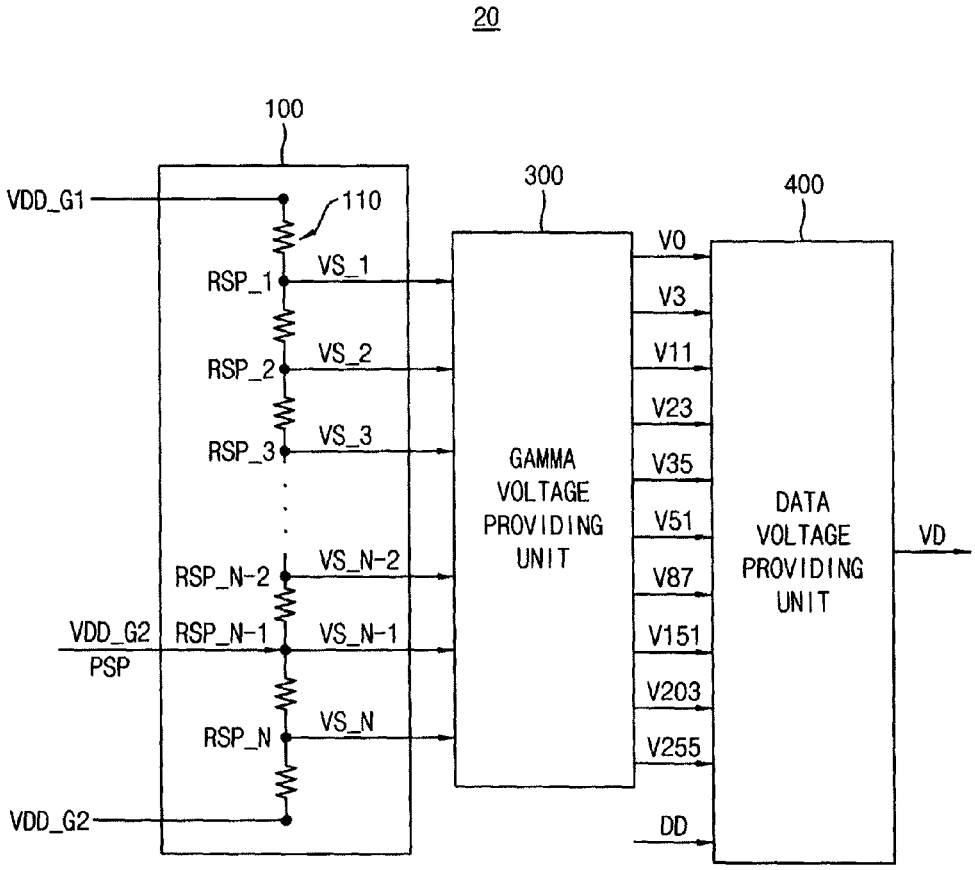
FIG. 10 illustrates an embodiment of a data generator in a display device.

FIG. 9 illustrating an embodiment of a display device 30*a*, and FIG. 10 illustrates an example of a data generator in the display device of FIG. 9.

Referring to FIGS. 9 and 10, a display device 30*a* includes a data voltage generator 20 and a pixel array 200. The data voltage generator 20 includes a string resistor unit 100, a gamma voltage providing unit 300, and a data voltage providing unit 400. The data voltage generator 20 provides a data voltage VD corresponding to a display data DD. The pixel array 200 displays an image based on the data voltage VD. The string resistor unit 100 provides a plurality of string voltages VS_1 to VS_N through a plurality of resistor string points RSP_1 to RSP_N in a string resistor 110.

The string resistor 110 is in the string resistor unit 100. The string resistor 110 is connected between a first gamma power supply voltage VDD_G1 and a second gamma power supply voltage VDD_G2. For example, a first string voltage VS_1 may be provided from a first resistor string point RSP_1. A second string voltage VS_2 may be provided from a second resistor string point RSP_2. In the same manner, an N-th string voltage VS_N may be provided from an N-th resistor string point RSP_N.

The gamma voltage providing unit 300 provides a plurality of gamma voltages V0 to V255 based on the plurality of string voltages VS_1 to VS_N. For example, the gamma voltage providing unit 300 may include one or more multiplexers and resistors. The gamma voltage providing unit 300 may provide a 1st to 256th gamma voltages V0 to V255 using a first to N-th string voltages VS_1 to VS_N, multiplexers, and resistors.

The data voltage providing unit 400 provides the data voltage VD corresponding to the display data DD based on the plurality of gamma voltages V0 to V255. As the first gamma power supply voltage VDD_G1 is changed, a power supply string point PSP to which the second gamma power supply voltage VDD_G2 is applied is determined. The power supply string point PSP is one of the plurality of resistor string points RSP_1 to RSP_N.

For example, when the display device including the gamma voltage generator 10*a* operates in a power save mode PSM, the power supply voltage ELVDD may be decreased. When the power supply voltage ELVDD is decreased, the reference voltage VREF that is changed according to the power supply voltage ELVDD, may be decreased. For the same display data DD, a difference between the reference voltage VREF and the data voltage VD may be constant. When the display device including the gamma voltage generator 10*a* operates in a power save mode PSM, if the reference voltage VREF is decreased, the data voltage VD may also be decreased. For example, when the reference voltage VREF is decreased by the delta voltage DV, if the data voltage VD is decreased by the delta voltage DV, the difference between the reference voltage VREF and the data voltage VD may be constant.

To decrease the data voltage VD, the first gamma power supply voltage VDD_G1 provided to the string resistor unit 100 may be decreased. When the first gamma power supply voltage VDD_G1 provided to the string resistor unit 100 decreases, the string voltages VS_1 to VS_N provided from the resistor string points RSP_1 to RSP_N may be decreased. When the string voltages VS_1 to VS_N are decreased, the data voltage VD corresponding to the display data DD may be decreased. Therefore, when the reference voltage VREF is decreased, the first gamma power supply voltage VDD_G1 may be decreased to decrease the data voltage VD.

However, when the first gamma power supply voltage VDD_G1 provided to the string resistor unit 100 is decreased, a voltage difference among the string voltages VS_1 to VS_N may be changed. For example, when the first gamma power supply voltage VDD_G1 is 1V, the first string voltage VS_1 provided from the first resistor string point RSP_1 may be 0.9V. The second string voltage VS_2 provided from the second resistor string point RSP_2 may be 0.8V. In the same manner, the ninth string voltage provided from the ninth resistor string point may be 0.1V. In this case, the voltage difference among the string voltages VS_1 to VS_N may be 0.1V.

For example, in case the first gamma power supply voltage VDD_G1 is 0.9V, the first string voltage VS_1 provided from the first resistor string point RSP_1 may be 0.81V. The second string voltage VS_2 provided from the second resistor string point RSP_2 may be 0.72V. In the same manner, the ninth string voltage provided from the ninth resistor string point may be 0.09V. In this case, the voltage difference among the string voltages VS_1 to VS_N may be 0.09V. The voltage difference among the string voltages VS_1 to VS_N may be 0.1V, even though the first gamma power supply voltage VDD_G1 is changed.

Therefore, as the first gamma power supply voltage VDD_G1 is changed, the power supply string point PSP to which the second gamma power supply voltage VDD_G2 is applied may be changed. For example, in case the first gamma power supply voltage VDD_G1 is 0.9V, the power supply string point PSP to which the second gamma power supply voltage VDD_G2 is applied may be a ninth resistor string point. In this case, the first string voltage VS_1 provided from the first resistor string point RSP_1 may be 0.8V. The second string voltage VS_2 provided from the second resistor string point RSP_2 may be 0.7V. In the same manner, the eighth string voltage provided from the eighth resistor string point may be 0.1V. In this case, the voltage difference among the string voltages VS_1 to VS_N may be 0.1V.

Therefore, in case the power supply string point PSP to which the second gamma power supply voltage VDD_G2 is applied is changed as the first gamma power supply voltage VDD_G1 is changed, the voltage difference among the string voltages VS_1 to VS_N is constant, even though the first gamma power supply voltage VDD_G1 is changed.

When the display device including the gamma voltage generator 10*a* operates in a power save mode PSM, the power supply voltage ELVDD may be decreased. When the power supply voltage ELVDD is decreased, the reference voltage VREF that is changed according to the power supply voltage ELVDD may be decreased. The data voltage VD may be decreased so that the difference between the reference voltage VREF and the data voltage VD is constant for the same display data DD.

To decrease the data voltage VD, string voltages VS_1 to VS_N provided from the string resistor unit 100 may be decreased. To decrease the string voltages VS_1 to VS_N, the first gamma power supply voltage VDD_G1 may be decreased. As the first gamma power supply voltage VDD_G1 is changed, the power supply string point PSP to which the second gamma power supply voltage VDD_G2 is applied may be changed.

In this embodiment, the gamma voltage generator 10*a* may decrease power consumption by applying the second gamma power supply voltage VDD_G2 to the power string point selected among the resistor string points RSP_1 to RSP_N as the first gamma power supply voltage VDD_G1 is changed.

In an example embodiment, the first gamma power supply voltage VDD_G1, a reference voltage VREF and the plurality of string voltages VS_1 to VS_N may be changed according to a delta voltage DV. The delta voltage DV may correspond to a change of a pixel power supply voltage ELVDD that is provided to the pixel array 200. For example, when the pixel power supply voltage ELVDD is decreased by the delta voltage DV, the first gamma power supply voltage VDD_G1 and the reference voltage VREF may be decreased by the delta voltage DV.

Figure 11:
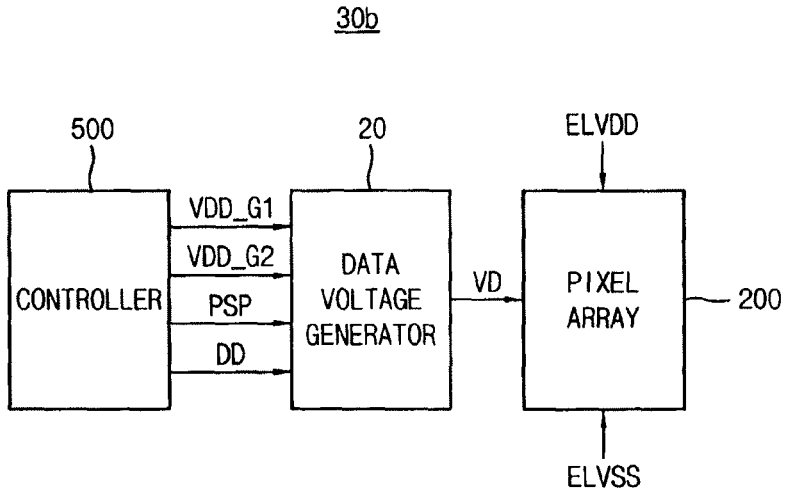
FIG. 11 illustrates another embodiment of a display device.

FIG. 11 illustrating another embodiment of a display device 30*b*. Referring to FIGS. 8, 10, and 11, the display device 30*b* may further include a controller 500 for controlling the pixel power supply voltage ELVDD, the first gamma power supply voltage VDD_G1, and the power supply string point PSP. For example, the controller 500 may control the pixel power supply voltage ELVDD provided to the pixel array 200. The controller 500 may control the first gamma power supply voltage VDD_G1 provided to the string resistor unit 100.

When the pixel power supply voltage ELVDD is changed, the reference voltage VREF may be changed. As the first gamma power supply voltage VDD_G1 is changed, the power supply string point PSP to which the second gamma power supply voltage VDD_G2 is applied may be changed. The controller 500 may provide the power supply string point PSP to the string resistor unit 100. In this case, the string resistor unit 100 may determine the resistor string point to which the second gamma power supply voltage VDD_G2 is applied based on the power supply string point PSP.

In an example embodiment, the controller 500 may include a register 510 storing a register value. The register value may control the pixel power supply voltage ELVDD, the first gamma power supply voltage VDD_G1, and the power supply string point PSP. For example, the controller 500 may provide the pixel power supply voltage ELVDD, the first gamma power supply voltage VDD_G1 and the power supply string point PSP corresponding to the register value based on a control signal.

Figure 12:
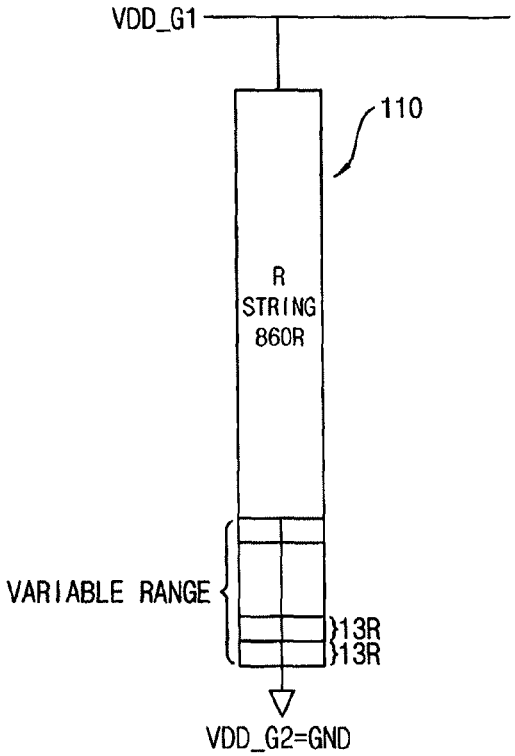

FIGS. 12 and 13 illustrating an example for setting of a register in the controller of FIG. 11. Referring to FIGS. 12 and 13, a bit number of the register 510 in the controller 500 may be, for example, 4 bits. The string resistor 110 may include 860 resistors. For example, when the value of the register 510 is 1 h, the delta voltage DV may be 0.101V. When the delta voltage DV is 0.101V, the power supply voltage ELVDD of the display device may be decreased by 0.101V. When the power supply voltage ELVDD of the display device is decreased by 0.101V, the reference voltage VREF may be decreased by 0.101V. When the reference voltage VREF is decreased by 0.101V, the first gamma power supply voltage VDD_G1 may be decreased by 0.101V. In this case, the power supply string point PSP to which the second gamma power supply voltage VDD_G2 is applied to may be increased by 13R.

For example, when the value of the register 510 is 8 h, the delta voltage DV may be 0.802V. When the delta voltage DV is 0.802V, the power supply voltage ELVDD of the display device may be decreased by 0.802V. When the power supply voltage ELVDD of the display device is decreased by 0.802V, the reference voltage VREF may be decreased by 0.802V. In case the reference voltage VREF is decreased by 0.802V, the first gamma power supply voltage VDD_G1 may be decreased by 0.802V. In this case, the power supply string point PSP to which the second gamma power supply voltage VDD_G2 is applied to may be increased by 193R.

In this embodiment, the gamma voltage generator 10*a* may decrease the power consumption by applying the second gamma power supply voltage VDD_G2 to the power string point, selected among the resistor string points RSP_1 to RSP_N, as the first gamma power supply voltage VDD_G1 is changed.

Figure 14:
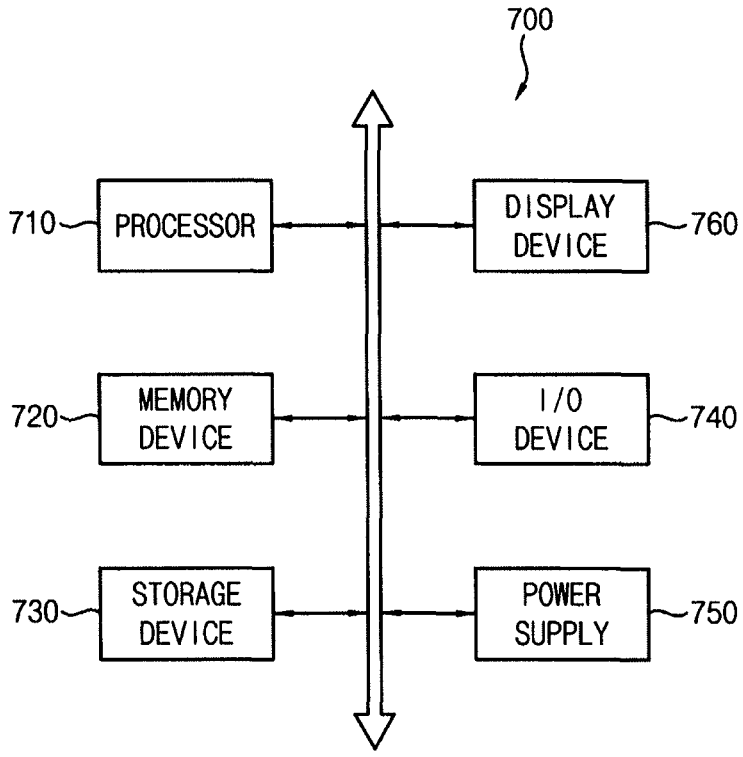
FIG. 14 illustrates an embodiment of a mobile device.

FIG. 14 illustrates an embodiment of a mobile device 700 which includes a processor 710, a memory device 720, a storage device 730, an input/output (I/O) device 740, a power supply 750, and an electroluminescent display device 760. The mobile device 700 may further include a plurality of ports for communicating a video card, a sound card, a memory card, a universal serial bus (USB) device, or other electronic systems.

The processor 710 may perform various computing functions or tasks. The processor 710 may be for example, a microprocessor, a central processing unit (CPU), etc. The processor 710 may be connected to other components via an address bus, a control bus, a data bus, etc. Further, the processor 710 may be coupled to an extended bus such as a peripheral component interconnection (PCI) bus.

The memory device 720 may store data for operations of the mobile device 700. For example, the memory device 720 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano-floating gate memory (NFGM) device, a polymer random access memory (PoRAM) device, a magnetic random access memory (MRAM) device, a ferroelectric random access memory (FRAM) device, and/or at least one volatile memory device such as a dynamic random access memory (DRAM) device, a static random access memory (SRAM) device, a mobile dynamic random access memory (mobile DRAM) device, etc.

The storage device 730 may be, for example, a solid state drive (SSD) device, a hard disk drive (HDD) device, a CD-ROM device, etc. The I/O device 740 may be, for example, an input device such as a keyboard, a keypad, a mouse, a touch screen, and/or an output device such as a printer, a speaker, etc. The power supply 750 may supply power for operating the mobile device 700. The electroluminescent display device 760 may communicate with other components via the buses or other communication links.

The aforementioned embodiments may be applied to any mobile device or any computing device. For example, the present embodiments may be applied to a cellular phone, a smart phone, a tablet computer, a personal digital assistant (PDA), a portable multimedia player (PMP), a digital camera, a music player, a portable game console, a navigation system, a video phone, a personal computer (PC), a server computer, a workstation, a tablet computer, a laptop computer, etc.

By way of summation and review, a method proposed for driving an OLED involves generating gamma voltages by applying the plurality of reference voltages that are different from each other. In accordance with one or more of the aforementioned embodiments, a gamma voltage generator includes a string resistor unit and a gamma voltage providing unit. The string resistor unit provides a plurality of string voltages through a plurality of resistor string points in a string resistor. The string resistor is in the string resistor unit. The string resistor is connected between a first gamma power supply voltage and a second gamma power supply voltage. The gamma voltage providing unit provides a plurality of gamma voltages based on the plurality of string voltages. As the first gamma power supply voltage is changed, a power supply string point that the second gamma power supply voltage is applied to is determined. The power supply string point is one of resistor string points.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A gamma voltage generator, comprising:

a resistor string to provide a plurality of string voltages through a plurality of resistor string points, the resistor string connected between a first gamma power supply voltage and a second gamma power supply voltage; and a gamma voltage provider to provide a plurality of gamma voltages based on the plurality of string voltages, wherein a power supply string point to which the second gamma power supply voltage is applied is changed from a first resistor string point to a second resistor string point of the plurality of resistor string points as the first gamma power supply voltage is changed, and wherein:

a voltage difference among the string voltages is constant before and after the first gamma power supply voltage is changed and the power supply string point is changed from the first resistor string point to the second resistor string point, and the gamma voltage provider is to provide the gamma voltages based on a different number of string voltages before and after the first gamma power supply voltage is changed and also based on the power supply string point changed from the first resistor string point to the second resistor string point.

2. The gamma voltage generator as claimed in claim 1, wherein the first gamma power supply voltage is changed based on a delta voltage, the delta voltage corresponding to a change of a reference voltage.

3. The gamma voltage generator as claimed in claim 2, wherein:

when the reference voltage is decreased by the delta voltage, the first gamma power supply voltage is decreased by the delta voltage.

4. The gamma voltage generator as claimed in claim 1, wherein:

the string voltages are changed according to a delta voltage, and the delta voltage corresponds to a change of the first gamma power supply voltage.

5. The gamma voltage generator as claimed in claim 4, wherein: when the first gamma power supply voltage is decreased, the string voltages are decreased.

6. The gamma voltage generator as claimed in claim 1, wherein:

as each of the string points approaches the first gamma power supply voltage, a resistor string point number corresponding to the resistor string points is decreased, and a power supply string point number is changed according to a delta voltage, the delta voltage corresponding to a change of the first gamma power supply voltage, the power supply string point number corresponding to the power supply string point.

7. The gamma voltage generator as claimed in claim 6, wherein:

when the first gamma power supply voltage is decreased by the delta voltage, the power supply string point number is decreased.

8. The gamma voltage generator as claimed in claim 7, wherein:

when the first gamma power supply voltage is increased by the delta voltage, the power supply string point number is increased.

9. The gamma voltage generator as claimed in claim 1, wherein the power supply string point is connected to one end of the string resistor, that is connected to the second gamma power supply voltage.

10. The gamma voltage generator as claimed in claim 9, wherein the second gamma power supply voltage is a ground voltage.

11. The gamma voltage generator as claimed in claim 1, wherein:

a second resistor string point among the plurality of resistor string points is adjacent to a first resistor string point and a third resistor string point, and a difference between a first string voltage provided through the first resistor string point and a second string voltage provided through the second resistor string point is substantially equal to a difference between the second string voltage provided through the second resistor string point and a third string voltage provided through the third resistor string point.

12. The gamma voltage generator as claimed in claim 1, wherein the gamma voltage generator includes a controller to control the first gamma power supply voltage and the power supply string point.

13. The gamma voltage generator as claimed in claim 12, wherein the controller includes a register to store a register value, the register value to control the first gamma power supply voltage and the change in power supply string point, and wherein the controller is to provide the first gamma power supply voltage and is to control the change in the power supply string point corresponding to the register value based on a control signal.

14. The gamma voltage generator as claimed in claim 1, wherein:

when the gamma voltage generator operates in a power save mode, the first gamma power supply voltage is decreased.

15. The gamma voltage generator as claimed in claim 1, wherein the number of the resistor string points changes when the first gamma power supply voltage is changed and the power supply string point is changed from the first resistor string point to the second resistor string point.

16. A display device, comprising:

a data voltage generator to provide a data voltage based on display data; and a pixel array to display an image based on the data voltage, the data voltage generator including:

a resistor string to provide a plurality of string voltages through a plurality of resistor string points, the resistor string connected between a first gamma power supply voltage and a second gamma power supply voltage;

a gamma voltage provider to provide a plurality of gamma voltages based on the plurality of string voltages; and a data voltage to provide the data voltage corresponding to the display data based on the plurality of gamma voltages, wherein, a power supply string point to which the second gamma power supply voltage is applied is to be changed from a first resistor string point to a second resistor string point of the plurality of resistor string points as the first gamma power supply voltage is changed and wherein:

a voltage difference among the string voltages is constant before and after the first gamma power supply voltage is changed and the power supply string point is changed from the first resistor string point to the second resistor string point, and the gamma voltage provider is to provide the gamma voltages based on a different number of string voltages before and after the first gamma power supply voltage is changed and also based on the power supply string point changed from the first resistor string point to the second resistor string point.

17. The display device as claimed in claim 16, wherein:

the first gamma power supply voltage, a reference voltage, and the plurality of string voltages are changed according to a delta voltage, and the delta voltage corresponds to a change of a pixel power supply voltage that is provided to the pixel array.

18. The display device as claimed in claim 17, wherein:

the first gamma power supply voltage and the reference voltage are decreased by the delta voltage when the pixel power supply voltage is decreased by the delta voltage.

19. The display device as claimed in claim 18, further comprising: a controller to control the pixel power supply voltage, the first gamma power supply voltage, and the change in the power supply string point.

20. The display device as claimed in claim 19, wherein:

the controller includes a register to store a register value, the register value to control the pixel power supply voltage, the first gamma power supply voltage, and the power supply string point, and the controller is to provide the pixel power supply voltage, the first gamma power supply voltage, and change in the power supply string point corresponding to the register value based on a control signal.

* * * * *